United States Patent [19]

Germain et al.

[11] Patent Number: 4,463,771

[45] Date of Patent: Aug. 7, 1984

[54] DEVICE FOR CLOSING THE ENDS OF A MACHINE FOR TREATING METAL SHEETS

[75] Inventors: Alfred Germain, Dunkerque-Malo-Les-Bains; Bernard Roth, Boulogne-Billancourt, both of France

[73] Assignee: Union Siderurgique Du Nord Et De L'Est De La France, Paris, France

[21] Appl. No.: 338,514

[22] Filed: Jan. 11, 1982

[30] Foreign Application Priority Data

Jan. 9, 1981 [FR] France ..... 81 00288

[51] Int. Cl.[3] ..... B08B 3/02

[52] U.S. Cl. ..... 134/122 R; 134/154; 134/183; 266/113

[58] Field of Search ..... 134/9, 15, 64 R, 64 P, 134/122 R, 122 P, 154, 183; 266/112–114

[56] References Cited

U.S. PATENT DOCUMENTS

| | | | |
|---|---|---|---|
| 1,916,806 | 7/1933 | Myrick | 134/183 X |
| 3,448,744 | 6/1969 | Szczepanski | 134/154 X |
| 4,185,648 | 1/1980 | Germain | 134/154 X |

FOREIGN PATENT DOCUMENTS

| | | |
|---|---|---|
| 2223096 | 10/1974 | France . |
| 2413139 | 7/1979 | France . |
| 2413140 | 7/1979 | France . |
| 2413141 | 7/1979 | France . |
| 2413467 | 7/1979 | France . |

*Primary Examiner*—Robert L. Bleutge

*Attorney, Agent, or Firm*—Cushman, Darby & Cushman

[57] ABSTRACT

The device provides an arrangement of the input and output ends of the machine which is of light and cheap construction, smaller in size and allows an adaptation of the machine in accordance with the width of the product to be treated. The device comprises, for each end of the machine, at least one rigid closing shutter carried by one of the frames of the machine. Guiding devices carried by this frame ensure a displacement of the or each shutter in a direction roughly perpendicular to the plane of the sheet passing through the machine. Devices for shifting the or each shutter are provided. The or each shutter cooperates by its free edge with the other frame of the machine so as to close in a substantially sealed manner the input or output end of the machine.

11 Claims, 6 Drawing Figures

DEVICE FOR CLOSING THE ENDS OF A MACHINE FOR TREATING METAL SHEETS

DESCRIPTION

The present invention relates to machines for treating and in particular cooling metal sheets or the like, of the type comprising a lower frame and an upper frame in which are mounted sets of sheet driving and guiding rolls which operate in pairs, the two frames defining an enclosure in which a treating fluid circulates. Such a machine is described in French patent application No. 73 10710 filed on Mar. 26, 1973 and published Oct. 25, 1974 as U.S. Pat. No. 2,223,096 and in French patent application Nos. 77 39833, 77 39834, 77 39835, 77 39836 filed on Dec. 30, 1977 and published July 27, 1979 as U.S. Pat. Nos. 2,413,139; 2,413,140; 2,413,141 and 2,413,467, respectively. In particular, the French Pat. No. 77 39835 concerns the arrangement of the input and output ends of such a machine and describes the presence, at each of said ends, of at least one shutter which is mounted to pivot about an axis parallel to the plane of the sheet and extends transversely of the direction of travel of this sheet, its being possible to bring the shutter to an upper position or a lower position by means of jacks, depending on whether a metal sheet or the like must or must not pass through the machine.

The arrangement described in this prior patent is on the whole satisfactory but may be criticized in certain respects:

the overall size of the shutters is relatively large and this increases the total length of the machine;

as the shutters are pivotally mounted between the two longitudinal walls of the frame, they have great length and must be of particularly rigid construction (box-structure); moreover, they must bear against beams which have sufficient length and this complicates the machine and increases its cost;

as the shutters have a length which corresponds to the total width of the machine, they do not permit the adaptation of the effective width of the input and output ends of the machine in accordance with the width of the treated product and there are leakages of the treating fluid.

An object of the present invention is to provide an arrangement of the input and output ends of a sheet treating machine which avoids these drawbacks and which is consequently lighter and cheaper in construction, has a smaller overall size and permits an adaptation in accordance with the width of the product to be treated.

The invention accordingly provides a device for closing the input and output ends of a machine for treating metal sheets or the like, said machine comprising an upper frame and a lower frame which define an enclosure in which may circulate a treating fluid, wherein there are provided, for each end of the machine, at least one rigid closing shutter carried by one of the frames, guiding means provided on said frame and allowing a displacement of the or each shutter in a direction which is roughly perpendicular to the plane of the sheet passing through the machine, and means for shifting the or each shutter, the or each shutter cooperating by a free edge thereof with the other frame so as to close in a substantially fluidtight manner the concerned end of the machine.

According to other features of the invention:

a plurality of juxtaposed shutters are provided at each end, these shutters being provided with separate shifting means;

the juxtaposed shutters have along their adjacent edges complementary profiles which ensure, on one hand, a correct relative guiding and, on the other hand, a good seal;

the other frame comprises a transverse groove which, in the closing position, cooperates with the free edge of the or each shutter.

The invention will now be described in more detail hereinafter with reference to the accompanying drawings which illustrate various embodiments of the invention and in which.

Figure 1:
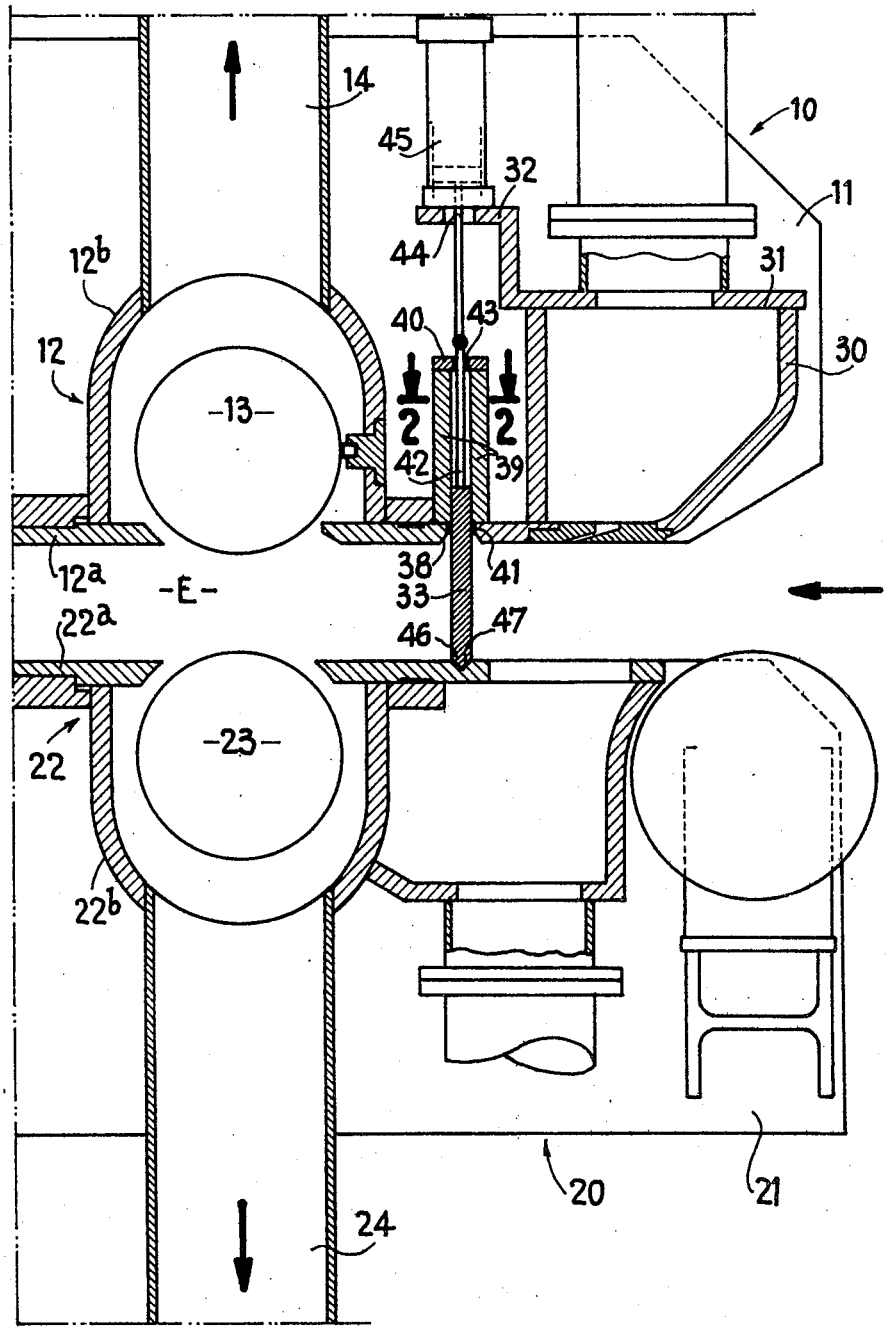
FIG. 1 is a partial vertical sectional view of the input end of a sheet cooling machine.

FIG. 1 shows the input end of a machine for cooling metal sheets and comprising an upper frame 10 and a lower frame 20. Each frame comprises lateral walls 11, 21 which are interconnected by metal cases, 12, 22 which include roughly planar portions 12*a*, 22*a* parallel to the sheet which must pass through the machine, and curved portions 12*b*, 22*b* which surround driving and guiding rolls 13, 23. The metal cases define an enclosure in which may circulate a cooling liquid, the enclosure being, for this purpose, connected to inlet and outlet pipes for this liquid, the pipes 14, 24 shown in the drawings being the outlet pipes.

Only the input end of the machine has been shown, but it will be understood that the output end thereof is, at least in the main, constructed in the same way. The lateral walls 11 of the upper frame are connected by a beam 30 which, in the illustrated embodiment, is in the form of a box-structure and whose horizontal upper wall 31 includes an extension 32 which extends toward the interior of the machine. In the space between this transverse beam and the adjacent case 12*b* defining the enclosure for the cooling fluid, there is disposed the closing device according to the invention. This device mainly comprises a plurality of juxtaposed rigid shutters 33 to 37 (FIG. 2) which have for example a thickness of between 10 and 30 mm. The central shutter 35 extends on each side of the longitudinal plane of symmetry of the machine represented by the line X—X. In respect of a machine which has a width of 4.20 m, the central shutter may for example have a width of 2 m and the four other shutters a width of 0.55 m. It wil be understood that the number and width of the shutters are chosen as desired.

In order to guide the shutters which are arranged in such manner as to be movable in translation in a vertical direction roughly perpendicular to the direction of passage of the sheet through the machine, the end horizontal wall of the upper frame includes a transverse slot 38 which extends throughout the width of the machine. Fixed on each side of this slot are two parallel plates 39 which are vertical and define a cavity into which the shutters may be withdrawn. This cavity is closed in a sealed manner in the upper part thereof by a collar 40 formed by a simple plate fixed to the vertical walls 39. On each side of the slot 38, the horizontal wall 12*a* includes sealing elements 41 which may be formed by wear plates of bronze or by linings of a material having a low coefficient of friction. The shutters carry in their upper part rods 42 which extend through the cover 41 in a sealed manner, for example through stuffing-boxes 43, and are pivotally mounted at their upper ends on rods 44 of jacks or cylinder devices whose bodies 45 are secured to the wall 32. In one embodiment, two or more rods 42 for each shutter may be provided, these rods being connected in their upper part to horizontal swingle-bars on which the jack rods 44 are pivotally mounted.

In the embodiment shown in FIG. 1, the lower free edge 46 of the shutters has a bevelled shape and cooperates with a groove 47 of complementary shape provided in the horizontal end wall 22*a* of the lower frame.

Figure 2:
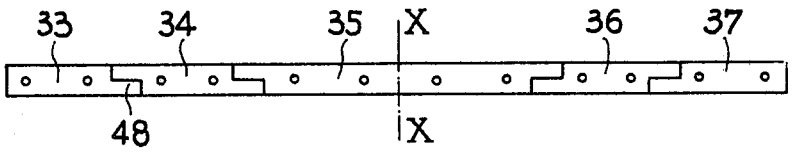
FIG. 2 is a sectional view taken on line 2—2 of FIG. 1.

According to an important feature of the invention, the various juxtaposed shutters have along their adjacent edges complementary profiles of which a number of variants are shown in FIGS. 2 to 5. In FIG. 2, these profiles are merely formed by steps 48 in a line broken at right angles the shape of which is clearly shown in FIG. 2.

Figure 3:
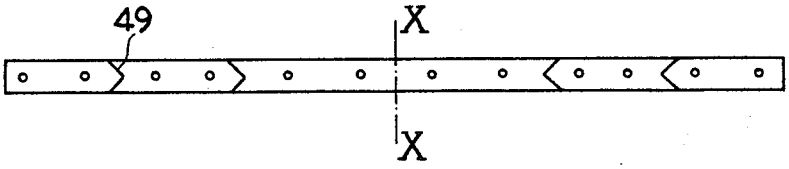
FIGS. 3 to 5 are views similar to FIG. 2 in respect of modifications.

In the embodiment shown in FIG. 3, these profiles 49 have a V shape respectively defined by a reentrant angle and a salient angle. Note that, in this case, the orientation of the Vs is such that possible leakages are directed toward the sides of the machine.

Figure 4:
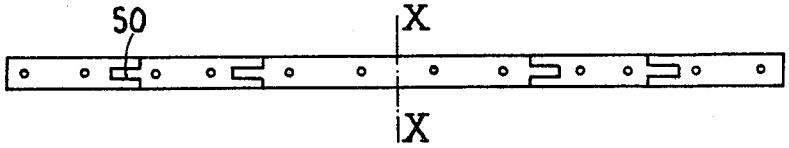

In the embodiment shown in FIG. 4, the joints 50 in the region of the adjacent edges of the shutters are of the tongue-and-groove type.

Figure 5:
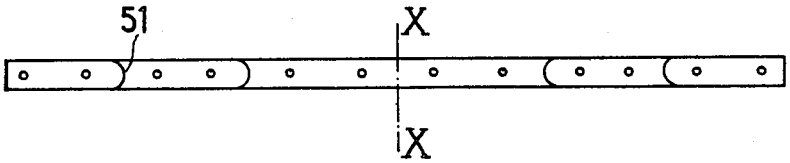

In FIG. 5, the complementary profiles 51 have a respectively concave and convex curved shape. Here again, the orientation is such that any possible leakages are directed toward the sides of the machine. Similar profiles, complementary to those of the shutters, may also be provided on the two lateral walls 11 of the frame, or sealing elements may be provided in contact with the vertical edges of the end shutters.

Figure 6:
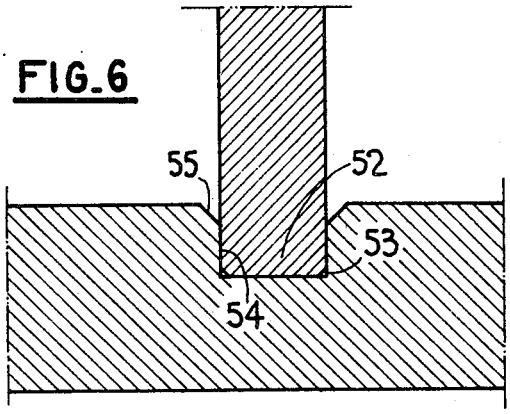
FIG. 6 is a detail view, to an enlarged scale, of a modification of the free edge of the shutters which cooperates with the lower frame.

Another variant is shown in FIG. 6 in respect of the lower free edge of the shutters and of the groove provided in the lower frame. Thus, this lower free edge 52 may merely include two lateral chamfers 53 while the groove 54 has a generally rectangular cross-sectional shape the two upper edges of which are rendered outwardly divergent by chamfers 55.

The operation of such an arrangement is very easy to understand. In the configuration shown in FIG. 1, ie. in the absence of a metal sheet passing through the machine, the shutters are placed in their lower or closing position. The liquid flowing in the machine then remains effectively enclosed within the machine. Possible leakages along their lower edge and along the adjacent edges of the juxtaposed shutters are reduced to a minimum by the adopted arrangements described hereinbefore. In particular, the complementary profiles of the vertical edges of the adjacent shutters perform a double sealing and guiding function. When a metal sheet must be introduced into the machine, means known per se, which need not be described in the present description, cause the actuation of the jacks 45 and the upward displacement of the shutters to their upper position at the suitable moment. When a plurality of juxtaposed shutters are provided, as shown in FIGS. 2 to 5, only the number of shutters 50 necessary for the passage of the sheet are raised to their upper position. In other words, the width of the opening formed at the input and output ends of the machine may be easily adapted to the width of the sheet and this constitutes an important advantage over prior arrangements.

All the objects of the invention have consequently been achieved, since the device formed by the shutters and their guiding and actuating means is particularly small and permits a corresponding reduction in the overall length of the machine and in the cost of the latter.

Preferably, this closing device is carried by the upper frame, However, it is possible to contemplate providing the closing device on the lower frame.

Having now described our invention what we claim as new and desire to secure by Letters Patent is:

1. In a machine for treating metal sheets, which machine has an input end and an output end, a device for closing said input and output ends, an upper frame and a lower frame defining an enclosure in which enclosure may circulate a treating fluid, said device comprising for each of said ends upwardly and downwardly movable closing shutter means carried by one of said frames, guide means carried by said one frame and cooperative with said shutter means to guide said shutter means in a direction substantially perpendicular to a plane of the enclosure containing said input and output ends of the enclosure, and means for shifting said shutter means, the improvement wherein said shutter means is rigid and said guide means comprise a first slot provided in said one frame and extending transversely throughout the width of said enclosure and provided with sealing elements interposed between the slot and said shutter means, said shutter means being cooperative by a free edge thereof with the other of said frames which latter is provided with a second transverse slot which is penetrated by said shutter means in a lowermost position of said shutter means whereby the corresponding end of the machine is closed in a substantially sealed manner, in a lowermost position of said shutter means.

2. A machine according to claim 1, comprising for each shutter means a cavity defined by two vertical walls which extend on each side of the corresponding slot, and a cover, said cavity receiving said shutter means in a retracted position of said shutter means.

3. A machine according to claim 1, wherein said actuating means comprise a cylinder device which has a rod which is connected to an upper part of said shutter means by a connecting rod.

4. A machine according to claim 3, wherein said shutter means extends through said cover with interposition of sealing means.

5. A machine according to claim 1, wherein said shutter means comprises at each of said ends of the machine a plurality of shutter elements in juxtaposed relation to each other, separate shifting means being provided for each shutter element.

6. A machine according to claim 5, wherein the juxtaposed shutter elements have along adjacent edges thereof complementary profiles which profiles ensure a correct relative guiding of the shutter elements and a good seal therebetween.

7. A machine according to claim 6, wherein said profiles comprise a line broken at two right angles.

8. A machine according to claim 6, wherein said profiles comprise a V-shape.

9. A machine according to claim 6, wherein said profiles comprise a tongue and groove connection.

10. A machine according to claim 6, wherein said profiles comprise a rounded shape.

11. A machine according to claim 5, wherein a central shutter element extends on each side of a median longitudinal plane of the machine, and lateral shutter elements are disposed symmetrically relative to said longitudinal plane.

* * * * *